US007412939B2

(12) United States Patent
Van Derryt

(10) Patent No.: US 7,412,939 B2
(45) Date of Patent: Aug. 19, 2008

(54) EMERGENCY BUOYANCY SYSTEM

(75) Inventor: Steven P. Van Derryt, Westampton, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 11/641,312

(22) Filed: Dec. 19, 2006

(65) Prior Publication Data

US 2008/0141917 A1 Jun. 19, 2008

(51) Int. Cl.
*B63B 43/10* (2006.01)

(52) U.S. Cl. ..... 114/68

(58) Field of Classification Search ..... 114/68
See application file for complete search history.

(56) References Cited

U.S. PATENT DOCUMENTS

| | | | | |
|---|---|---|---|---|
| 2,918,030 | A | 12/1959 | Bagnall | |
| 2,966,131 | A | 12/1960 | Elijah | |
| 3,019,754 | A | 2/1962 | Welshausen | |
| 3,046,925 | A | 7/1962 | De Lislo | |
| 3,053,218 | A | 9/1962 | Erickson | |
| 3,070,059 | A | 12/1962 | Testa | |
| 3,092,853 | A * | 6/1963 | Owen | 114/69 |
| 3,324,816 | A | 6/1967 | Vogelsang | |
| 3,340,842 | A | 9/1967 | Winslow | |
| 3,556,034 | A | 1/1971 | Miller | |
| 3,602,177 | A | 8/1971 | Helbig | |
| 3,696,773 | A | 10/1972 | Morris | |
| 3,814,043 | A | 6/1974 | Krout | |
| 4,458,618 | A | 7/1984 | Tuffier | |
| 4,887,541 | A | 12/1989 | Rodemann | |
| 6,327,988 | B1 * | 12/2001 | Seidel | 114/68 |
| 6,481,378 | B1 * | 11/2002 | Zemach | 119/223 |
| 6,598,550 | B1 | 7/2003 | Patel | |

FOREIGN PATENT DOCUMENTS

| | | |
|---|---|---|
| GB | 1442869 | 7/1976 |

* cited by examiner

*Primary Examiner*—Stephen Avila
(74) *Attorney, Agent, or Firm*—Duane Morris LLP

(57) ABSTRACT

A system is disclosed for providing emergency buoyancy to a vessel in response to a flooding condition in one or more vessel compartments cause by external explosion, collision or projectile damage. The system may comprise one or more flexible inflatable bags disposed on an upper inboard bulkhead of one or more vessel compartments. When a flooding condition is detected in a compartment due to breach of the ship's hull, an integral gas delivery system may provide a quantity of gas to the interior of the bag in that compartment, causing the bag to expand and push flooding water back out through the ship's hull. This displacement of water, and the buoyant force provided by the filled bag will enable the ship to maintain nominal floatation. The system may be configured to provide a controlled expansion of the bag(s) to enable personnel located in the compartment sufficient time to evacuate.

20 Claims, 4 Drawing Sheets

EMERGENCY BUOYANCY SYSTEM

FIELD OF THE INVENTION

The invention relates generally to emergency buoyancy systems for ships, and more particularly to a system for providing controlled buoyancy for ships with flooded compartments caused by damage from explosion, collisions or projectile impacts.

BACKGROUND OF THE INVENTION

As the U.S. Navy proceeds toward more complex ship systems and reduced manning level they have made Survivability and the Ability to "Fight Hurt" the cornerstone of the 21st century combatant. All ships will have automated damage control systems that will provide rapid response to battle damage through the use of internal sensors connected thru networks to computers which will monitor and compare temperature levels, water levels, smoke, etc. Similarly, designed survivability provides a redundancy of systems, power, armor, and optimum internal arrangement all with the intent of minimizing the effects of battle damage.

A review of available literature relating to ship battle damage, such as published battle damage reports for U.S. Navy ships from WW II and British Royal Navy ships in the 1982 Falklands War between UK and Argentina, and reports of the damage sustained by U.S. Navy ships in the Middle East, reveals that the majority of ships damaged in combat operations were still afloat for at least 24 hours after the engagement ended. For cases in which the ship was not on fire, or had not sustained a magazine explosion, it should have had a good chance of survival. Uncontrollable flooding of the ship caused by the intake of water through hull and compartment breaches is what finally resulted in their sinking. When a ship hull is damaged by a shell, mine or missile, the compartment hit will be ripped apart by the explosion and will be open to the sea. There is very little that can be done, in the short term, to counteract that level of damage.

Secondary damage to the ships hull caused by the explosion's overpressure wave will distort the deck frames and bulkheads of those compartments located adjacent to the explosion impact. These distortions will cause the metal in the deck frames and bulkheads to tear and split. These compartments will also suffer punctures in the metal from shrapnel that will allow water to slowly flood the compartment. Each square foot of sea water that enters the ship thru these openings to the sea subtracts from the positive buoyancy of the ship, and eventuality the weight of this water will exceed the displacement of the ship and it will sink.

Traditionally, sailors fighting to control such damage in these adjacent compartments will use wood and other soft materials to manually plug the many holes in the compartment deck frames and bulkheads. The Damage Controlmen (DC) will use portable pumps to remove the water from the compartments. Each damage control team is usually at least 4 sailors. Their work to control flooding usually progresses slowly, and is dependent upon the available manpower and the ability of the sailors to reach all parts of the damaged compartments.

Additionally, when considered in the context of the modern Navy's reduced manning philosophy, any given ship can ill-afford to take sailors away from their critical combat duties to perform damage control duties.

Thus, there is a need for a system that can counter flooding of ship compartments caused by explosions. There is also a need for an automated system to prevent (or reverse) flooding of a ship caused by secondary damage to one or more of the ship's compartments. Such a system should be automatically activated in response to a flooding condition in one or more compartments, and advantageously may be controllable from the ship's damage control station to allow the damage control officer to monitor and adjust, if necessary, the operation of the system. Additionally, the system should operate in a manner that is safe, so that sailors located in the space at the time the damage occurs will have time to evacuate or be evacuated (in the case of inured personnel).

SUMMARY OF THE INVENTION

A system is disclosed for providing emergency buoyancy for a vessel, comprising a flexible bag mounted to a top panel of a compartment within the vessel. The flexible bag may have a compressed size and an expanded size, the expanded size being substantially equal to the free space of the compartment. The system may further comprise a controllable inflation apparatus for providing a quantity of gas to an interior volume of said flexible bag to configure said flexible bag to its expanded size. The inflation apparatus may be controlled from a centralized damage control station located within the vessel, such that the inflation apparatus may be controlled in the event of damage to the compartment. Thus arranged, when the bag is configured to the expanded size, the bag increases the buoyancy of the vessel.

A method is also disclosed for providing emergency buoyancy for a vessel, comprising: mounting a flexible bag within a compartment within said vessel, the flexible bag having a compressed size and an expanded size, the expanded size being substantially equal to the free space of the compartment; providing an inflation apparatus coupled to the flexible bag for providing a quantity of gas to an interior volume of the flexible bag to configure the bag to its expanded size; and providing said gas to the interior volume of the flexible bag in response to a flooding condition detected in said compartment. The providing step may comprise controlling the integral inflation apparatus from a centralized damage control station located within the vessel. Thus, configuring the flexible bag to the expanded size increases the buoyancy of the vessel.

A system is further disclosed for providing buoyancy for a vessel. The system may comprise an expandable bag mounted in a compartment of said vessel, the bag having a deflated state and an inflated state. The system may further comprise an inflation apparatus associated with the bag, the inflation apparatus being operable to provide a quantity of gas to an interior volume of the bag to configure the bag from the deflated state to the inflated state. The system may also comprise a sensor associated with the compartment, the sensor being operable to detect a flooding condition in the compartment. Thus configured, when the bag is configured to the inflated state, the bag increases the buoyancy of the vessel

BRIEF DESCRIPTION OF THE DRAWINGS

The details of the invention, both as to its structure and operation, may be obtained by a review of the accompanying drawings, in which like reference numerals refer to like parts, and in which.

DETAILED DESCRIPTION

A system is disclosed for use in an emergency for removing water from a damaged ship compartment (and/or preventing further ingress of water to a damaged compartment) to restore or maintain positive buoyancy of the ship. An enclosed flotation bag with an integral inflation system may be mounted to a bulkhead of one or more designated compartments in a ship. This inflation system may comprise compressed gas supplied from the ship's compressed air system, or it,may be supplied in individual cylinders. Alternatively, the gas may be locally generated by a hydrazine and calcium hydride-seawater reaction gas generating arrangement.

When a level of flooding in the affected compartment is detected, gas may be provided to the bag, causing it to expand to either push flooding water back out of the hole(s) in the compartment or to prevent additional flooding water from entering the compartment. Control of the gas supply may be manual or automatic, on-site or remote, and in one embodiment may be controlled from the ship's damage control station.

Figure 1:
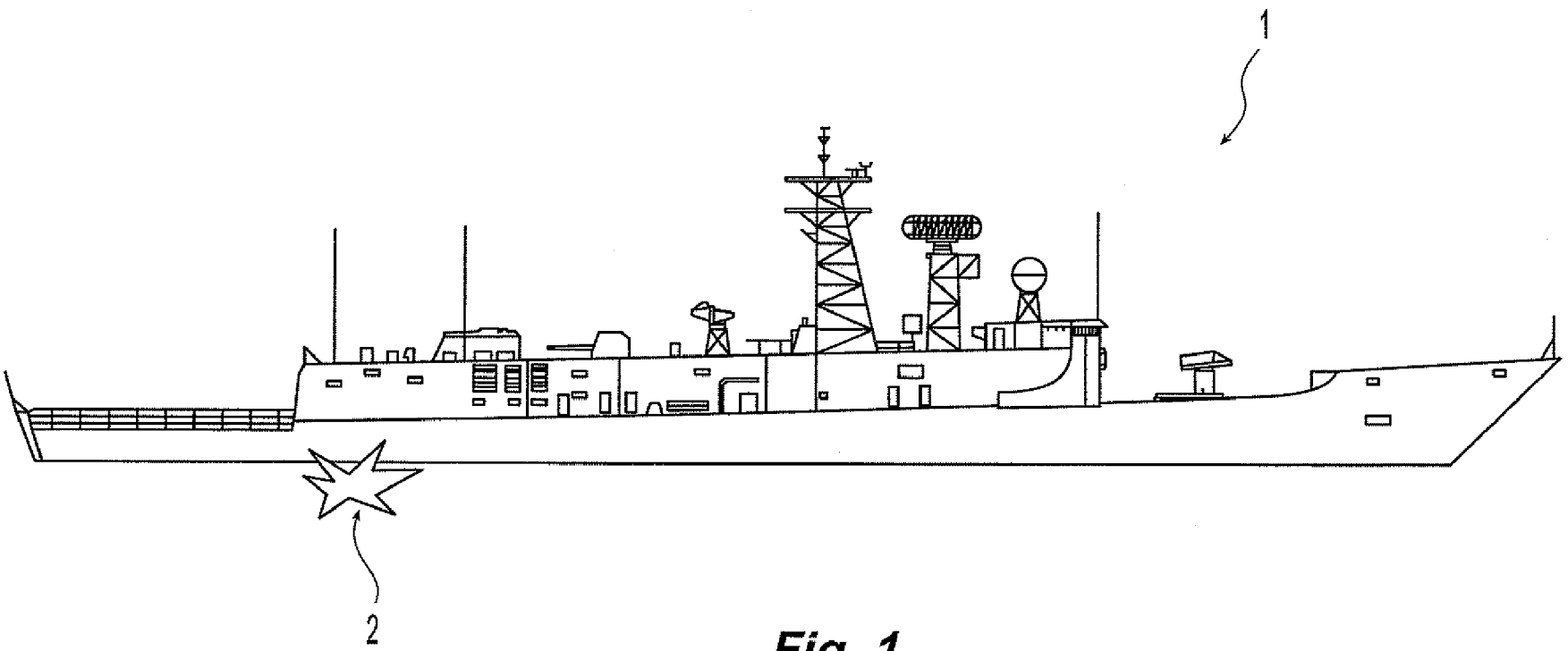
FIG. 1 is a side view of an exemplary vessel within which the inventive system is installed.
Figure 2:
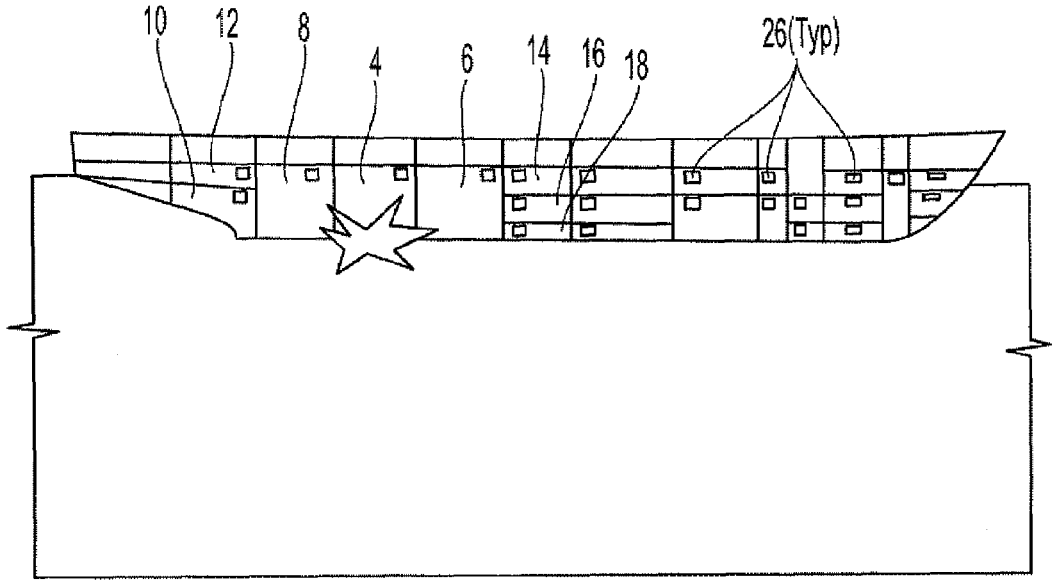
FIG. 2 is a cross-sectional view of the vessel of FIG. 1, taken along line 2-2 of FIG. 1, showing placement of the inventive system in a plurality of internal ship compartments, and an explosion adjacent to one of the compartments.

Referring to FIG. 1, a typical Naval vessel 1 of the frigate type is shown. A blast 2 is illustrated near the aft of the ship, such as may be caused by a torpedo, mine or other surface or subsurface weapon. FIG. 2 illustrates the plurality of individual internal compartments that make up the living, working and service spaces onboard the vessel 1. Blast 2 is shown centered on one compartment 4 in particular. As can be seen with reference to FIG. 3, however, blast 2 has initially ruptured the hull and has flooded compartment 4, as well as two adjacent compartments 6, 8. Not illustrated is the collateral damage caused to the compartments 10, 12, 14, 16 & 18 adjacent to compartments 4, 6 and 8. Such damage may comprise punctures of the adjacent compartment bulkheads due to flying shrapnel and debris. While such punctures may not be as severe as those which caused the initial flooding of compartments 4, 6 & 8, over time they may still result in severe flooding of the adjacent compartments that can contribute to a critical loss of buoyancy and/or stability that may ultimately cause sinking of the ship 1.

Figure 4:
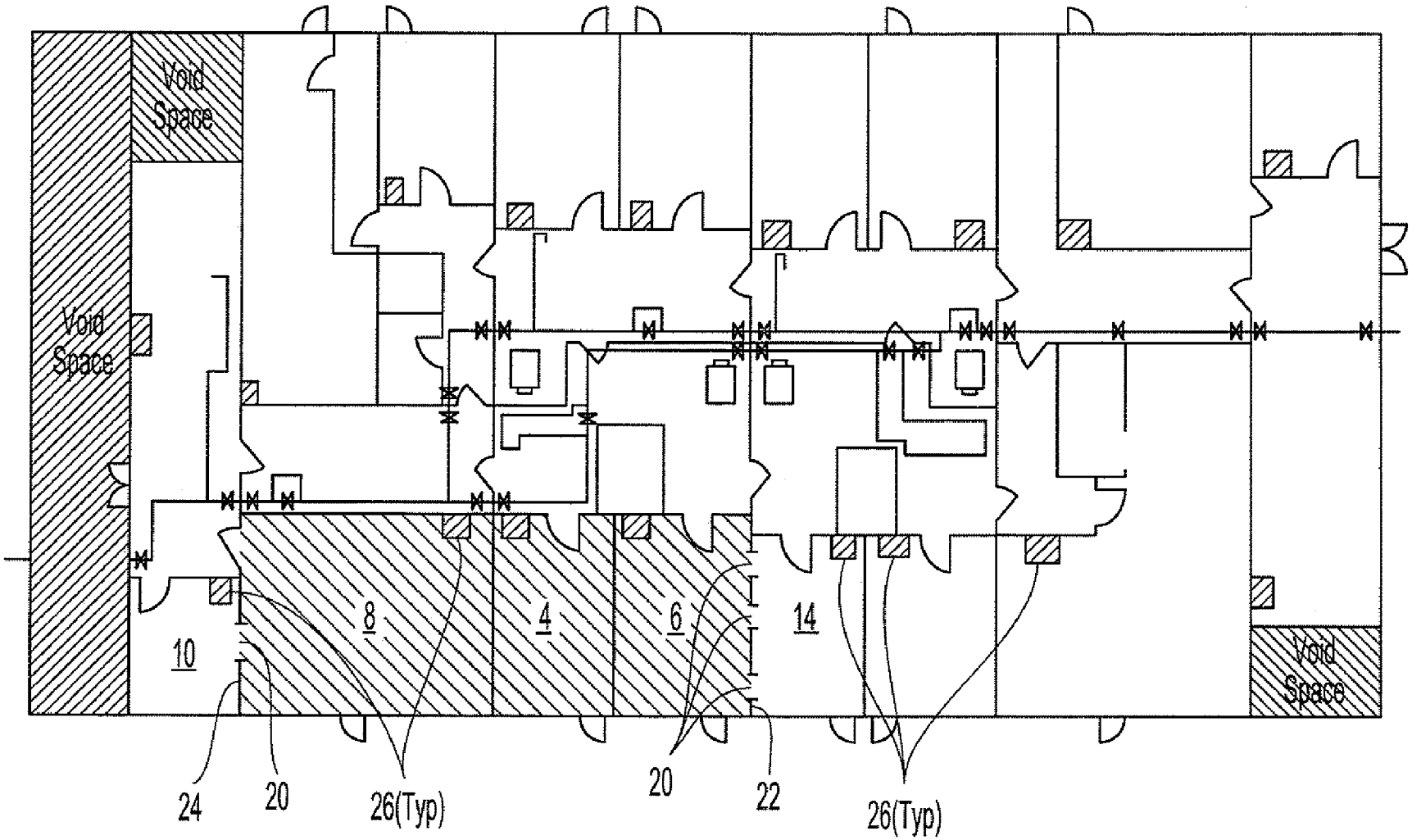
FIG. 4 is a partial cross-sectional view of the vessel of FIG. 1, taken along line 4-4 of FIG. 1.

FIG. 4 shows a plurality of exemplary shrapnel punctures or breaches 20 in the bulkheads 22, 24 between compartment 6 and 14, and compartments 8 and 10, as may be expected to result from the initial blast 2. Thus, the water that initially floods the primary compartments 4, 6 & 8 may be expected to flow through these breaches 20 into the adjacent compartments 10 and 14. Left unchecked, compartments 10 and 14 (as well as lower adjacent compartments 12, 16 & 18, all of which may be expected to suffer similar puncture damage to that of compartments 10 and 14) may be expected to completely flood given sufficient time.

Although the flooding of the adjacent compartments 10-18 can be expected to progress at a slower rate than that of the primary compartments 4-8, the ultimate implications for decreased buoyancy can be as severe or more so, depending upon the size of the adjacent compartments, whether they are watertight compartments, and whether the doors or other openings in those compartments are properly sealed.

Figure 3:
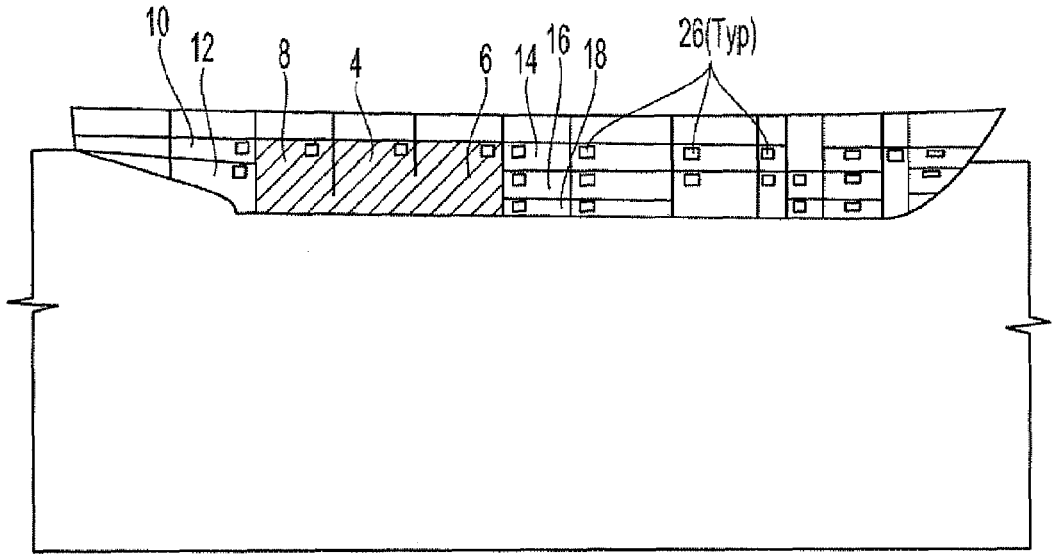
FIG. 3 is a further cross-sectional view of FIG. 1, taken along line 2-2 of FIG. 1, showing damage-induced flooding of several the compartments shown in FIG. 2.
Figure 5:
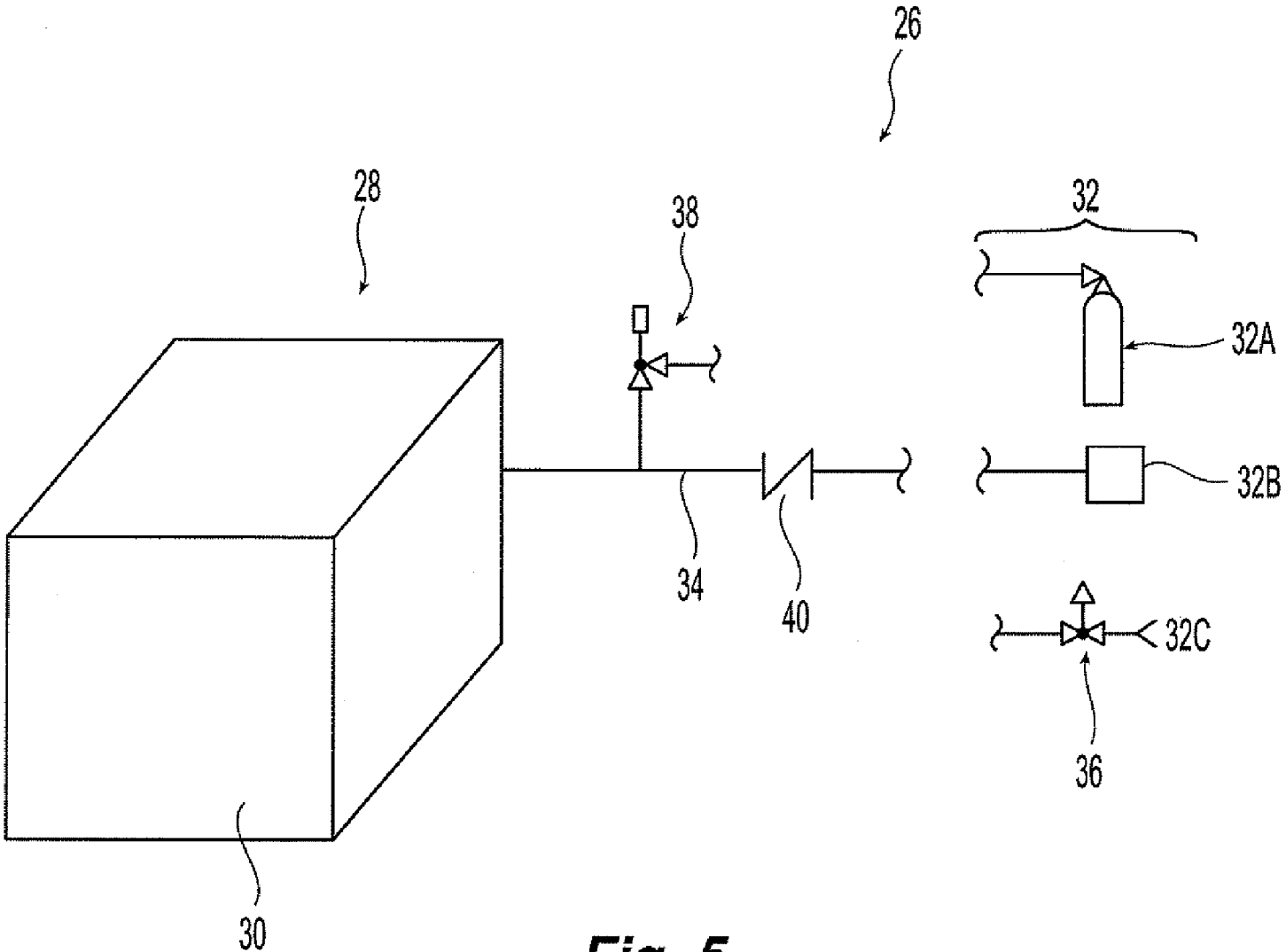
FIG. 5 is a schematic of the inventive system installed in an exemplary compartment.

The inventive system 26 is illustrated in FIGS. 2-4 installed in a plurality of compartments throughout the ship 1. With reference to FIG. 5, the system 26 may comprise a container 28 for holding and protecting the flexible bag 30, as well as a compressed gas source 32 connected to the flexible bag 30 via a suitable supply line 34. The complete system 26 may occupy an area roughly the size of a kitchen cabinet.

The gas source 32 may be any suitable source of gas such as air, carbon dioxide, nitrogen and the like. In one embodiment, the gas source 32 comprises a compressed gas cylinder 32A charged with sufficient gas to completely fill the flexible bag 30 at a desired rate and to a desired inflation size. The cylinder 32A may be a standard rechargeable compressed gas cylinder ubiquitous to naval vessels. In one embodiment, the cylinder 32A may be a high pressure composite Kevlar and fiberglass cylinder rated to 4000 psi. Such a rating may allow the cylinder 32A to be compact, while still providing the desired fill rate and volume of gas for filling the bag 30. Further, a Kevlar/fiberglass composite material would provide protection against damage from shrapnel or projectiles caused by the initial blast 2.

Alternatively, the gas supply 32 may comprise a vessel 32B containing one or more chemicals plurality of chemicals whose reaction product is a gas suitable for inflating the bag 30. In one exemplary embodiment, the vessel 32B may contain a hydrazine and calcium hydride-seawater reaction gas generating arrangement.

As a further alternative, the gas source 32 may be the ship's high-pressure (HP) air system 32C. A suitable throttle valve 36 may be provided between the ship's air system 32B and the flexible bag 28 to ensure that the bag fills at a desired rate, while minimizing the chance of rapid over-pressurization of the bag 30, which could damage the bag and cause it to fail. In on embodiment, a relief valve 38 may be provided in the supply line 34 to ensure over-pressurization does not occur. Additionally, a check valve 40 may be provided in the gas supply line to prevent deflation of the bag 30 once it has been inflated.

It will be appreciated that using the ship's HP air system could leave the system 26 and the ship 1 vulnerable in the instance in which the HP air system becomes damaged during combat. Thus, the HP air system could be used as a backup supply to the cylinders 32A or the chemical gas generation vessels 32B.

The bag 30 may be made from any of a variety of suitably tough materials. In one embodiment the bag 30 may be made of high strength synthetics like nylon, polyester, Kevlar, or combinations thereof, and may further protected by tough, chemically impervious coating of vinyl and urethane. Providing a bag with a Kevlar component is expected to protect the bag 30 from shrapnel or projectile damage or from damage during inflation such as when the bag 30 expands against sharp structures within the space. Regardless of the materials of construction, the bag 30 preferably will be sufficiently flexible that it can mold itself around objects in the space, such as tables, etc., and to continue expanding to push water out of the compartment.

The bag 30 may be activated from the damage control station on board the ship 1 or it could be activated from a panel located outside the compartment. Alternatively, each bag 30 could be independently and automatically controlled from within the associated compartment.

The bag 30 may be mounted at or near the top of the compartment on the bulkhead located furthest away from the ship's hull. This would allow the bag to be supported by the deck above it when fully inflated. It also ensures that the bag 30 is out of the way and will normally have little or no effect on personnel working in the space.

The expected size of the bag 30 in its undeployed, unexpanded state may be about 1-foot deep by about 3-feet high by about 2-feet wide. It could be mounted near the top of the compartment, out of the way of personnel, machinery, piping and ventilation. To connect the bag 30 to the local control panel or the master damage control system, a simple hole could be drilled in the bulkhead leading to the passageway.

The bag 30 could be mounted within a container, or it could be mounted to the bulkhead or deck without a container. Where a container is provided, it will preferably be made from Kevlar reinforced fiberglass or plastic.

The bag's rate of expansion may be controlled to allow the bag 30 to fully fill in about 5 to 10 minutes to a pressure of about 2 atmospheres. This expansion rate is desirable because, as the bag starts to fill, water in the compartment will be forced out the same opening that allowed it to enter. An overly-fast expansion could trap water inside the compartment, and could also cause damage to the bag itself due to rapid over-pressurization. Additionally, the slow expansion rate will enable the crew (injured or otherwise) sufficient time to evacuate the compartment without being injured and/or trapped by the inflating bag 30.

Further, filling the bag 30 to 2 atmospheres will provide sufficient pressure to force flood water out of the compartment, and will provide a desired degree of buoyancy. This low inflation would likely not result in harm to personnel even if they were unable to evacuate prior to the bag filling completely.

In one embodiment, a kill switch may be provided within the compartment to enable a trapped individual to prevent expansion of the bag 30. Additionally, a manual switch may be provided on or adjacent to the bag 30 to enable damage control personnel to deflate the bag in order to effectuate repair of the damage that caused the flooding of the associated compartment.

When the flotation bag 30 is fully filled, any water still in the compartment will be forced out by the pressure of the enclosed bag and will be prevented from re-entering the compartment. Once filled, the flotation bag 30 may require no further action on the part of the damage control team. As noted, the bag(s) may be quickly deflated to allow damage control teams to restore the watertight integrity to the compartment, or they may be left in place until the ship receives outside help.

In addition to providing flooding control and remediation, the system 26 may also be used to prevent a fire or closed space explosion resulting from spilled fuel. Most combustion engines in the Navy use diesel fuel, and Gas Turbine engines use JP-5. If the tanks that hold the fuels are damaged (again, due to an explosion, collision, or projectile impacts), the fuel could leak into nearby compartments. The fuel vapors could fill the compartment and cause a closed space explosion if ignited. The additional damage to the ship caused by a closed compartment explosion could be worse than the original damage that caused the leak. If a compartment was to start filling up with leaking fuel a fire could result in that compartment that could lead back to the leaking fuel tank.

Since a fire or a closed compartment explosion must have a triangle of oxygen, heat and fuel in order to take place, removing any one of these three factors will eliminate the chance of such a fire/explosion occurring. If a compartment was to fill with leaking fuel or fuel vapors, the expanding bag 30, inflated with carbon dioxide ($CO_2$) or nitrogen ($N_2$) gas, would push the fuel and vapors out of the compartment in the same manner as previously described in relation to flooding water. The compartment would then be nearly completely occupied by a bag 30 of inert nonflammable gas that would not allow a fire or explosion to take place. In addition neither the fuel nor its vapors could reenter the compartment, and thus a fully inflated bag 30 would remove oxygen and fuel from the fire triangle.

One benefit of providing a centralized control of the multiple bags 26, which may be provided throughout the vulnerable compartments of the ship, is that that the inflation of individual bags 26 may be adjusted in combination with the ship's list control system, thus providing the damage control officer an additional tool for stabilizing the ship. Thus, in on embodiment, the gas supply 32 is automatically actuated once a flooding condition is sensed, such as by receiving a signal from a suitable sensor located within the associated compartment. In another embodiment, the gas supply 32 may be manually actuated from the ship's damage control station in response to an alarm condition generated by a similar sensor. Suitable sensors can be standard float switches, or they may be wireless sensors that can send a signal to the ship's damage control station via a wireless network link. Alternatively, on newer ships, the sensor could be hard wired via the ship mesh network.

In one embodiment, the system 26 may be implemented as part of the U.S. Navy's active SMART SHIP program, which is devoted to the reduction of manning requirements. One part of the SMART SHIP program is the implementation of technology to remotely and reliably determine the real time status of every compartment in the ship. This has lead to the development of the micro-electromechanical sensor (MEMS) system. The sensors will detect temperature, water, chemicals and pressure, to name a few. The MEMS will use a wireless system to send its information to a node in the ships computer network. The MEMS and the wireless network are designed to be easily retrofitted to current ships. The inventive system 26 could also be retrofitted to current ships and connected to the MEMS and wireless system.

Alternatively, or in addition, the gas supply system 32 may be manually actuated from a panel located in the ship's passage, directly outside the associated compartment. Furthermore, the rate at which gas is supplied to the individual bags 30 may be controlled via computer, and the expansion of a plurality of bags 30 may be controlled simultaneously.

An example of how the system would work will now be provided. An exemplary ship compartment is a cube of 10 feet resulting in a total of 1000 cubic feet of space. Five (5) of these compartments exist along the side of the hull. The middle compartment is badly damaged in an explosion or collision and is open to the sea. The two compartments on ether side start to flood due to punctures in the bulkheads. Within a short time the 5 compartments could contain over of 320,000 pounds of seawater (1000 cubic feet)×(5 compartments)×(64 lbs per cubic foot of sea water)=320,000 lbs. If floatation bags 30 were employed in the four compartments with punctures or tears in the bulkheads, the bags 30 would force the water out of these 4 compartments, in the process restoring 256,000 pounds of positive buoyancy to the ship. (1000 cubic feet)×(4 compartments)×(64 lbs per cubic foot of seawater)=256,000 lbs. Furthermore, the fully inflated bag 30 would effectively minimize re-entrance of water into those compartments in the ship.

There is no automated system that will ever replace the resourcefulness, ingenuity and inventiveness of Navy sailors when their ship is in danger. But with reduced manning, disclosed system 26 would permit a ship to quickly and with little crew intervention minimize the damage of a hit and allow the ship to continue to fight after being hit.

The invention claimed is:

1. A system for providing emergency buoyancy for a vessel, comprising:

a plurality of flexible bags mounted within a plurality of respective compartments within said vessel, said flexible bags each having a compressed size and an expanded size;

a controllable inflation apparatus coupled to each of the plurality of flexible bags for providing a quantity of gas to an interior volume of the flexible bags to configure the flexible bags to their expanded size;

wherein said controllable inflation apparatus is controllable from a centralized damage control station located within the vessel to enable a user to individually remotely monitor and individually adjust inflation of all of the plurality of flexible bags at a single location to inflate at least one of the plurality of flexible bags independent from at least one other of the plurality of flexible bags in the event of damage to at least one of the plurality of respective compartments; and wherein when at least one of the plurality of flexible bags is configured to the expanded size, the bag increases the buoyancy of the vessel.

2. The system of claim 1, wherein the inflation apparatus comprises a source of compressed gas.

3. The system of claim 2, wherein the source of compressed gas comprises a compressed gas container.

4. The system of claim 1, wherein the inflation apparatus comprises first and second chemical substances which, when mixed together, react to generate a volume of gas sufficient to fill the flexible bag to its expanded size.

5. The system of claim 1, wherein the inflation apparatus provides gas to the interior volume of said flexible bag at a rate sufficient to configure the bag from the compressed size to the expanded size in about 5 to 10 minutes.

6. The system of claim 1, wherein the inflation system comprises a connection to the vessel's compressed gas system.

7. The system of claim 1, further comprising a plurality of flexible bags each mounted to a top panel of a respective one of a plurality of compartments within said vessel, wherein each of said plurality of flexible bags further has an associated inflation apparatus.

8. The system of claim 1, wherein said inflation apparatus provides a quantity of gas to the interior volume of the flexible bag to achieve an internal bag pressure of about 2 atmospheres when the bag is in the expanded size.

9. A method for providing emergency buoyancy for a vessel, comprising:

mounting a plurality of flexible bags within a plurality of respective compartments within said vessel, said plurality of flexible bags each having a compressed size and an expanded size;

providing an inflation apparatus coupled to each of the plurality of flexible bags for providing a quantity of gas to an interior volume of said flexible bags to configure said flexible bags to their respective expanded size; and providing said gas to the interior volume of at least one of the plurality of flexible bags in response to a flooding condition detected in said compartment;

wherein said providing step comprises controlling said inflation apparatus from a centralized damage control station located within the vessel, said providing step further comprising controlling said inflation apparatus to individually remotely monitor and individually adjust the inflation of all of the plurality of flexible bags at a single location to inflate at least one of the plurality of flexible bags independent from at least one other of the plurality of flexible bags; and wherein configuring the flexible bag to the expanded size increases the buoyancy of the vessel.

10. The method of claim 9, wherein the flooding condition is detected by a sensor located within the compartment.

11. The method of claim 9, wherein the step of providing said gas comprises dispensing gas from a compressed gas container.

12. The method of claim 9, wherein the step of providing said gas comprises providing first and second chemical substances which, when mixed together, react to generate a volume of gas sufficient to fill the flexible bag to its expanded size.

13. The method of claim 9, wherein the providing step comprises providing said gas to the interior volume of said flexible bag at a rate sufficient to configure the bag from the compressed size to the expanded size in about 5 to 10 minutes.

14. The method of claim 9, wherein the step of mounting a flexible bag to a top panel of a compartment within said vessel comprises providing a plurality of flexible bags and mounting each of said plurality of flexible bags to a respective one of a plurality of compartments within said vessel.

15. The method of claim 9, wherein said providing step comprises providing a quantity of said gas to the interior volume of the flexible bag to achieve an internal pressure of about 2 atmospheres when the bag is in the expanded size.

16. A system for providing buoyancy for a vessel, comprising:

a plurality of expandable bags mounted in a plurality of respective compartments of said vessel, the plurality of expandable bags each having a deflated state and an inflated state;

an inflation apparatus associated with each of the plurality of expandable bags, the inflation apparatus being operable to provide a quantity of gas to an interior volume of each of the plurality of expandable bags to the configure the bags from the deflated state to the inflated state; and a sensor associated with the compartment, the sensor being operable to detect a flooding condition in the compartment;

wherein the inflation apparatus is controllable from a centralized damage control station to individually remotely monitor and individually adjust the inflation of all of the plurality of flexible bags at a single location to enable a user to inflate at least one of said plurality of expandable bags independent from at least one other of said plurality of expandable bags.

17. The system of claim 16, wherein the inflation apparatus is controllable to configure at least one of the plurality of expandable bags from the deflated state to the inflated state in 5-10 minutes.

18. The system of claim 16, wherein the sensor is configured to provide a signal to the centralized damage control station when a flooding condition is detected in the compartment.

19. The system of claim 18, wherein the signal is sent to the damage control station via a wireless connection.

20. The system of claim 19, wherein the inflation apparatus comprises a cylinder of compressed gas, the cylinder containing sufficient gas to inflate the expandable bag to a pressure of about 2 atmospheres.

* * * * *